United States Patent [19]

Leu

[11] Patent Number: 4,909,015

[45] Date of Patent: Mar. 20, 1990

[54] APPARATUS FOR THE FABRICATION OF PORTABLE TUBULAR-SHAPED PACKAGES FORMED OF PRINTED PRODUCTS

[75] Inventor: Willy Leu, Pfäffikon, Switzerland

[73] Assignee: Ferag AG, Hinwil, Switzerland

[21] Appl. No.: 259,562

[22] Filed: Oct. 18, 1988

[30] Foreign Application Priority Data

Oct. 21, 1987 [CH] Switzerland ..... 4115/87

[51] Int. Cl.[4] ..... B65B 63/04

[52] U.S. Cl. ..... 53/118; 53/587; 242/59

[58] Field of Search ..... 53/118, 117, 116, 430, 53/587, 399; 242/59

[56] References Cited

U.S. PATENT DOCUMENTS

| | | | |
|---|---|---|---|
| 4,528,794 | 7/1985 | Thierstein | 53/118 |
| 4,575,988 | 3/1986 | Meier | 53/430 X |
| 4,589,603 | 5/1986 | Müller | 53/430 X |
| 4,748,793 | 6/1988 | Brookman | 53/119 |
| 4,768,768 | 9/1988 | Reist | 242/59 X |
| 4,811,548 | 3/1989 | Reist | 53/118 X |

FOREIGN PATENT DOCUMENTS

| | | |
|---|---|---|
| 689556 | 6/1964 | Canada . |
| 0300742 | 1/1989 | European Pat. Off. . |
| 86129 | 11/1908 | Fed. Rep. of Germany . |
| 2322051 | 3/1977 | France . |
| 85/00576 | 2/1985 | PCT Int'l Appl. . |

*Primary Examiner*—James F. Coan

*Attorney, Agent, or Firm*—Fleit, Jacobson, Cohn, Price, Holman & Stern

[57] ABSTRACT

Printed products arriving in imbricated formation are delivered by band conveyors to a wind-up location. At the wind-up location the printed products are wound into a printed product roll by a belt element guided about a winding core. Before the last printed products of the imbricated formation have been delivered to the wind-up location a foil is introduced between these last printed products and the downstream located band conveyor of the aforementioned band conveyors. This foil is wound-up together with the printed products. A tensioned foil section of the foil which has been infed to the wind-up location is severed by a cutter device. The thus formed printed product package composed of printed products is wound-up into a printed product roll and the foil section which extends about the wound-up printed product roll is stripped from the winding core by an ejector device and deposited upon a support table.

20 Claims, 3 Drawing Sheets

APPARATUS FOR THE FABRICATION OF PORTABLE TUBULAR-SHAPED PACKAGES FORMED OF PRINTED PRODUCTS

CROSS-REFERENCE TO RELATED APPLICATION

This application is related to the commonly assigned, co-pending U.S. application Ser. No. 07/049,586, filed Apr. 30, 1987, now U.S. Pat. No. 4,811,548, and entitled "METHOD OF, AND APPARATUS FOR, FABRICATION OF PORTABLE TUBULAR-SHAPED PACKAGES FORMED OF PRINTED PRODUCTS, SUCH AS NEWSPAPERS, PERIODICALS AND THE LIKE AND PORTABLE PACKAGE PRODUCED ACCORDING TO THE METHOD".

BACKGROUND OF THE INVENTION

The present invention relates to a new and improved construction of apparatus for the fabrication of portable, substantially tubular-shaped packages composed of printed products, such as newspapers, magazines, periodicals and the like. These printed products are delivered in an imbricated or shingled formation and wound-up to form a printed product roll. A holder element extends about the printed product roll and serves for retaining together such printed product roll.

From German Patent Publication No. 3,330,485, and the cognate British Published Patent Application No. 2,126,188, as well as the cognate commonly assigned, co-pending U.S. application Ser. No. 07/059,851, filed June 8, 1987, and entitled "METHOD OF PREPARING A SHIPMENT PACKAGE OF PRINTED PRODUCTS ARRIVING IN AN IMBRICATED FORMATION AND PACKAGE OBTAINED THEREBY", it is known to form a ready-for-shipment package by winding-up printed products arriving in imbricated or shingled formation into a printed product roll or package. This printed product roll or package can be manually transported and the individual printed products can be removed from the center of the printed product roll or package. The disintegration of the printed product roll or package is prevented by placing a holding or holder element, and specifically a wrapper or envelope about the printed product roll or package.

SUMMARY OF THE INVENTION

Therefore with the foregoing in mind it is a primary object of the present invention to provide a new and improved construction of apparatus for the fabrication of printed product rolls or packages which does not suffer from the aforementioned drawbacks and shortcomings of the prior art constructions.

Another and more specific object of the present invention is directed to the provision o a new and improved construction of apparatus for the fabrication of portable, substantially tubular-shaped packages or rolls formed of printed products, in an exceedingly efficient, reliable and product-protective manner.

Yet a further notable object of the present invention is directed to an improved construction of apparatus for the fabrication of portable, substantially tubular-shaped packages or rolls formed of printed products which arrive in imbricated or shingled formation, wherein such apparatus is relatively simple in construction and design, extremely reliable in operation, not readily subject to breakdown and malfunction, and requires a minimum of maintenance and servicing.

Still a further noteworthy object of the present invention is directed to providing an apparatus for fabricating portable, substantially tubular-shaped packages or rolls formed of products, typically printed products and especially newspapers, periodicals and the like, which are wound-up in an exceedingly reliable and efficient manner into a printed product roll which is then furnished with a holding element or wrapper or the like preventing unravelling or disintegration of the formed product roll.

Now in order to implement these and still further objects of the invention, which will become more readily apparent as the description proceeds, the apparatus of the present development for the fabrication or manufacture of portable, substantially tubular-shaped printed product packages or rolls, among other things, is manifested by the features that a rotatably mounted winding core or mandrel is arranged downstream of infeed means which define a predetermined path of movement or travel of the imbricated or shingled formation of the printed products. Furthermore, there are provided means for the placement of or application of the printed products upon the winding core or mandrel or at printed products which have already been wound thereupon, as the case may be. The means for placement of the printed products upon the winding core or mandrel drivingly act upon a side or face of the printed products which faces away from the winding core or mandrel. There is also provided a delivery device for the delivery or supply of the holding or holder element or wrapper into the path of travel of the imbricated formation of printed products. This delivery device opens at that side of the predetermined path of travel of the imbricated formation of printed products at which there are effective the means for the placement of the printed products upon the winding core or mandrel. Additionally, there is provided a package removal facility comprising an ejector or stripper device for ejecting or stripping the finished printed product package or roll.

According to a preferred construction of the apparatus, the means for the placement or application of the printed products upon the winding core or mandrel comprises an endless, preferably revolvingly driven belt or band element. This endless belt or band element is guided about the winding core or mandrel and the holding or holder element at least during the winding-up of the printed products. The infed printed products are introduced between the winding core or mandrel and the belt or band element. By virtue of this design there is realized in a simple manner a compact or tight winding-up or coiling of the printed products. It is unnecessary to provide any drive for the winding core or mandrel when the belt element is revolvingly driven. The printed products which are to be wound-up transmit the revolving motion of the belt or band element to the winding core or mandrel.

According to a further preferred embodiment of the apparatus of the present invention, there is arranged beneath the winding core a band or belt conveyor which can be displaced out of the operating or effective region of the winding core. This winding core or, as the case may be, the wound-up printed product roll thereupon is loosely rotatably supported at the conveying-active run of the band conveyor. By means of this band or belt conveyor the printed products can be delivered in so-called underfeed or in a disposition where they are fed from below to the winding core or mandrel and wound thereupon. The position of the winding core in relation to the conveying-active run of the band conveyor is automatically accommodated to the product roll thickness, in other words the size of the already wound-up printed product roll or package. Due to the fact that the band conveyor can be shifted out of the operative region of the winding core, the winding core and, more specifically, the printed product package wound thereupon can be rendered freely accessible or exposed to permit ejection or stripping of the wound printed product package or roll without having to elevationally adjustably drive the winding core.

By virtue of the fact that the belt element is guided at the band conveyor at least over a partial region thereof which is arranged upstream of the winding core and disposed substantially parallel to the conveying-active run of the band conveyor, there is accomplished an orderly infeed of the imbricated formation into the conveying gap between the belt element and the winding core or the printed products already wound-up on the winding core, as the case may be.

According to a further preferred embodiment of the invention, the winding core or mandrel is rotatably arranged at a pivotable lever or lever member which is mounted to be pivotable about an axis extending substantially parallel to the lengthwise axis of the winding core or mandrel. The lower end or terminal position of this pivotable lever is defined or fixed by an impact or stop element in such a manner that the lengthwise axis of the winding core or mandrel extends above the conveying-active run of the band conveyor. In this way there is ensured that upon displacement or shifting of the band conveyor into the region of the winding core, the latter comes to bear upon the conveying-active run of such band conveyor. Furthermore, and by virtue of the foregoing, there is defined the position of the printed product package for the ejection or stripping thereof from the winding core or mandrel.

The aforementioned delivery or supply device for the holding element or wrapper advantageously comprises means for the unwinding of the wrapper or envelope foil from a foil supply roll and for severing a foil section as well as for the infeed of the same into the path of travel of the imbricated formation of printed products. In this way, there can be appreciably simplified the handling of the holding element or wrapper or the like.

This delivery or supply device preferably comprises a revolvingly driven band or belt conveyor for the infeed of the wrapping or envelope foil into the path of travel of the imbricated formation of printed products. At the conveying-active run of such band conveyor there bears the foil which has been unwound or payed-off of the foil supply roll or the like. This foil can be delivered in a tensioned state and free of folds or creases.

According to a further preferred embodiment of the invention, the means for the unwinding of the foil comprises two substantially parallel, mutually spaced, rotatably mounted unwinding rolls or rollers for the rotatable loose supporting or mounting of the supply roll for the foil. At least one of these two rotatably mounted unwinding rolls is brakingly driven. The replacement or exchange of the foil supply roll is thus markedly simplified in that a new replacement foil supply roll need only be loosely placed upon the rotatably mounted unwinding rolls. Due to braking of the aforementioned unwinding roll or roller there can be applied a tensile stress or load to the unwound foil which allows the thus tensioned foil, which serves as the holding element or wrapper, to be snugly or tightly wound about the printed product roll to thus form a compact securely retained printed product package.

A brake element or unit which can be brought to act upon the foil is preferably arranged forwardly or upstream of the band conveyor of the foil delivery device. With this arrangement, the foil also then remains in a tensioned or taut state even if the foil unwinding operation has been completed. This band conveyor can continuously revolve so that the foil, while being retained or held back by the brake element or unit, can frictionally slide upon the conveying-active run or the conveying-active runs of the band conveyor and thus there is retained the internal tension or tensional stress or load which has been applied to the foil.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the apparatus for the fabrication of portable or carryable, substantially tubular-shaped or tube-like packages formed of printed products or the like has been depicted as needed for one skilled in the art to readily understand the underlying principles and concepts of the invention while simplifying the illustration of the drawings. In the description to follow and based upon the showing of FIGS. 1 and 2 there will be described such exemplary embodiment of apparatus for the fabrication of printed product packages provided with a holding or retention element which extends about the roll or package formed of printed products.

Figure 1:
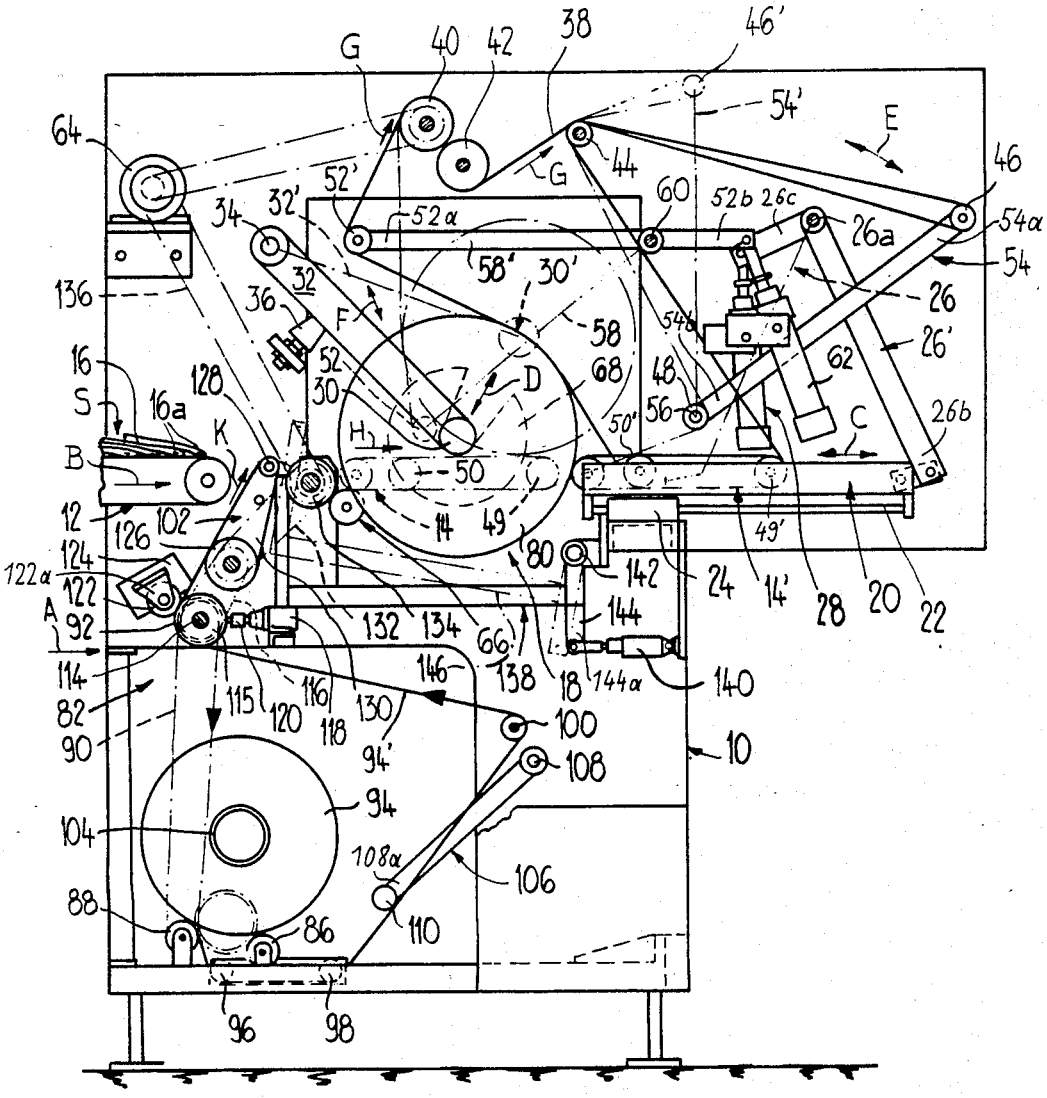
FIG. 1 illustrates in side and partly sectional view, taken substantially along the line I—I of FIG. 2, an apparatus for the fabrication of substantially tubular-shaped printed product packages according to the present invention.

Turning attention now more specifically to FIG. 1, the product package-fabrication apparatus will be seen to comprise a frame or framework or the like, generally indicated by reference numeral 10, at which there are arranged in succession or tandem two band or belt conveyors or conveyor devices 12 and 14. The first band conveyor or conveyor device 12, which has only been partially illustrated, serves for the infeed or delivery of printed products 16 to a wind-up location or station 18. These printed products 16 arrive upon the band conveyor 12 in an imbricated or shingled formation or array S and are wound-up into a roll at the wind-up location or station 18 in order to ultimately form a wound-up printed product package or roll. The product conveying or conveyance direction of the revolvingly driven band or belt conveyor 12 has been conveniently designated by reference character B in FIG. 1.

In the infed or delivered imbricated or shingled formation S of the printed products 16, each individual printed product 16 bears upon the next successive or downstream located printed product 16. This in effect means that the leading edges **16*a* of tee printed products 16 of the infed or delivered imbricated formation S are located at the underside of the imbricated formation S. The second band or belt conveyor 14 is arranged in a displacement device here shown as a carriage or slide device 20 which is mounted for reciprocatory or to-and-fro displacement movements in the direction of the double-headed arrow C in a guide device or guide means 24 arranged at the frame 10 by means of two guide rods 22, only one of which is particularly visible in the illustration of FIG. 1**.

At this carriage or carriage device 20, there engages one arm **26*b* of an angle lever or lever member 26 which is pivotably mounted in the frame 10 for pivotal motion about a shaft 26*a*. The other arm 26*c* of this angle lever 26 is operatively coupled to a piston-and-cylinder unit or device 28. By means of this piston-and-cylinder unit 28, the angle lever 26 can be pivoted into the position designated by reference character 26', and thus, the carriage or carriage device 20 is displaced towards the right of the showing of FIG. 1 in the direction of the double-headed arrow C. In this way, the band conveyor 14 can be retracted out of the operative position thereof depicted in chain-dot lines in FIG. 1, where this band conveyor 14 is located at the wind-up location or station 18, into a package release or delivery position which has been conveniently illustrated in FIG. 1 with full lines and designated by reference character 14'**.

Furthermore, there is provided at the wind-up location or station 18 a substantially cylindrical winding core or mandrel 30 which is freely rotatably mounted at a pivot lever or lever member 32 which, in turn, is pivotably seated upon a shaft or shaft member 34. This pivotable or pivotal lever 32 and in conjunction therewith the winding core or mandrel 30 can be pivoted or rocked in the direction of the double-headed arrow D of FIG. 1. The pivotal lever 32 and the winding core 30 have been depicted in FIG. 1 with full lines in their lower pivoted position. On the other hand, the upper pivoted position of the pivotable lever 32 and the winding core 30 has been equally depicted in FIG. 1 in chain-dot lines and respectively designated by reference characters 32' and 30'. In its lower pivoted position the pivotable lever or lever member 32 bears against an impact or stop member 36.

Additionally, an endless belt or band element 38 constitutes part of the package winding apparatus. This endless belt or band element 38 is guided over a number of deflection rolls or rollers 40 to 52. As to these deflection rolls or rollers 40 to 52 it will be observed that the deflection rolls 40, 42, 44 and 48 are spatially fixedly mounted in the frame 10, the deflection rolls or rollers 49 and 50 are mounted in the carriage or carriage device 20, whereas the deflection rolls or rollers 46 and 52 are pivotably mounted. For this purpose, the deflection roll 46 is mounted at one end **54*a* of a lever or lever member 54 which at its other end 54*b* is seated to be pivotable and biased in clockwise direction upon a shaft or shaft member 56. The lengthwise axis of this shaft member 56 coincides with the axis of rotation of the deflection roll 48. The lever or lever member 54 and in conjunction therewith the deflection roll 46 can be rocked to-and-fro in the direction of the double-headed arrow E of FIG. 1. The one end or terminal position of the lever 54 and the deflection roll 46 has been depicted with full lines, whereas the other end or terminal position has been shown with chain-dot lines and respectively designated by reference characters 54' and 46'**.

The deflection roll 52 is mounted at one lever arm **52*a* of a double-armed lever or lever member 58 which is pivotably mounted for movement in the direction of the double-headed arrow F of FIG. 1 about a shaft or shaft member 60 arranged at the frame 10. At the other lever arm 52*b* of this double-armed lever 58 there engages a piston-and-cylinder unit 62 which can pivot the double-armed lever 58 together with the deflection roll 52 into the upper end or terminal position, indicated by the respective reference characters 58' and 52', and depicted in full lines. The lower end or terminal position of the double-armed lever 58 and the deflection roll 52 has been shown in chain-dot lines. The deflection roll 40 is driven in a clockwise direction by a drive unit or drive 64, so that the belt or band element 38 can be revolvingly driven in the direction of the arrow G of FIG. 1. A friction drive or drive device 66 revolvingly drives the band or belt conveyor 14 in the operative position depicted in chain-dot lines in the direction of the arrow H of FIG. 1**.

Figure 2:
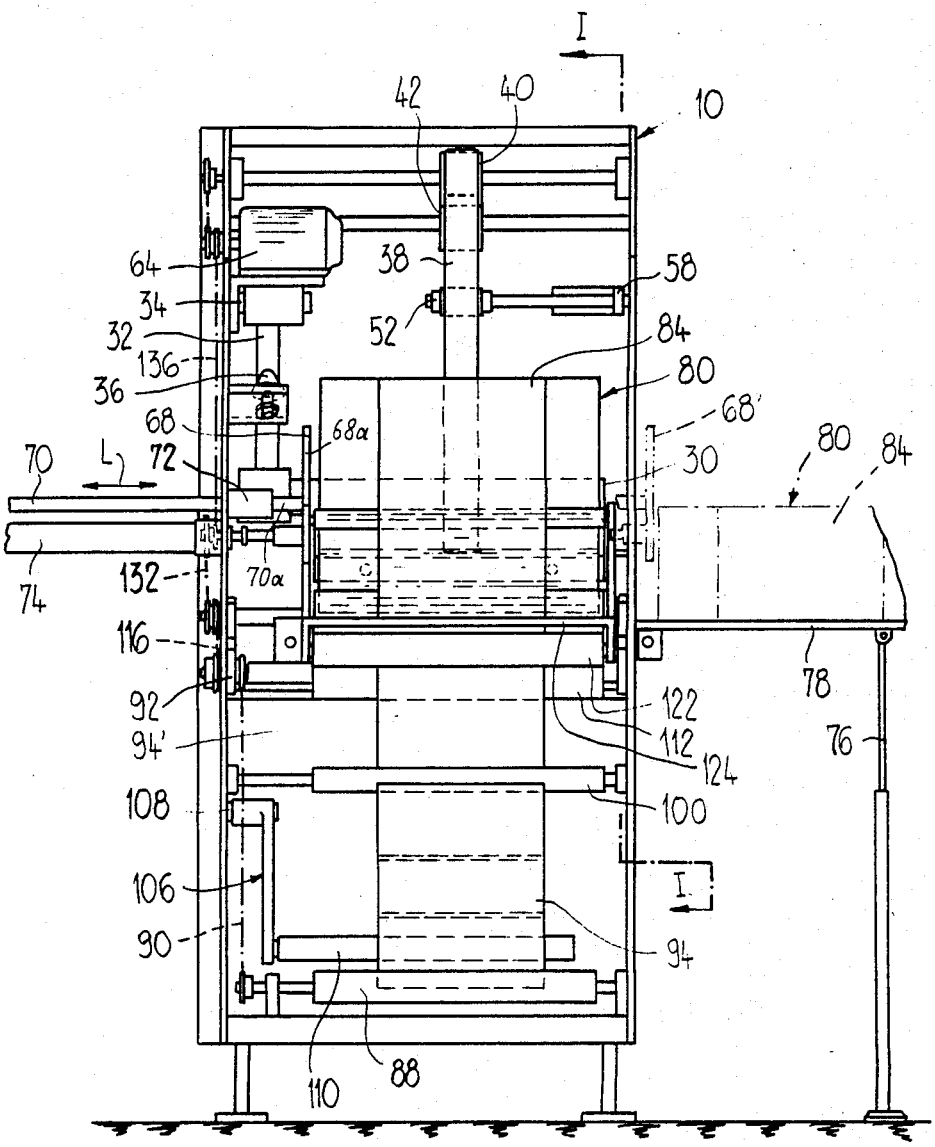
FIG. 2 illustrates the apparatus depicted in FIG. 1 in front view looking in the direction of the arrow A of FIG. 1, and for purposes of clarity in the portrayal and simplification of the illustration, certain of the components or parts appearing in FIG. 1 have been conveniently omitted in FIG. 2.

Furthermore, a package removal device here shown as a substantially plate-shaped ejector or stripper device 68 having a plate-like stripper element **68*a* is located at a spatially predetermined or fixed location at the wind-up location or station 18. This ejector or stripper device 68 is secured at one end 70*a* of a rod or rod member 70 which is displaceably guided in a guide bearing 72 for movement in the direction of the double-headed arrow L as shown in FIG. 2. The ejector or stripper device 68 partially engages about or encircles a portion of the winding core 30 when in its lowered position. In order to displace or shift the ejector device 68, there is operatively connected therewith a suitable piston-and-cylinder unit 72. The completely extended or thrusted-out position of the ejector device 68 has been depicted in chain-dot lines at the right-hand side of FIG. 2 and designated by reference character 68'. A support table or table member 78 is arranged at the frame 10 opposite the piston-and-cylinder unit or device 74. This support table 78 is additionally supported by a support or strut device 76. Each of the finished or completed and ejected printed product packages 80 bear upon the support table 78, as shown at the right-hand side of FIG. 2**.

Reverting again to FIG. 1, there is arranged upstream of the wind-up or winding location or station 18, a delivery or supply device 82 for holding or holder elements or wrappers 84 which retain together the individual product rolls forming the printed product packages 80. This delivery or supply device 82 for the holding elements 84 merges or opens into the path of movement or conveyance of the imbricated formation S of printed products 16. One of the holding elements or wrappers 84 which has been wrapped about the finished printed products 80 has been shown in FIG. 2.

It will be observed that at the frame 10 there are rotatably mounted two substantially parallel, mutually spaced unwinding rolls or rollers 86 and 88. The unwinding roll or roller 88 is operatively connected by a chain or chain member 90 or other suitable power-transmitting element with a roll or roller 92. A supply roll or roller 94 is placed upon the unwinding rolls 86 and 88. This supply roll 94 carries a supply of foil or web material for forming the holding elements or wrappers 84, and it will be seen that the foil 94' which has been payed-off of the supply roll 94 is guided about stationary and rotatably mounted deflection rolls 96, 98 and 100 arranged at the frame 10 to the roll or roller 92 and from that location to a further band or belt conveyor 102 which is arranged downstream or following such roll or roller 92. This foil or web 94' is wound-up at the foil supply roll 94 upon a winding core or mandrel 104 which, when all of the supply of the foil material or foil 94' has been unwound from such foil supply roll 94 bears upon both of the unwinding rolls 86 and 88, as such has been shown in FIG. 1 in chain-dot lines. Between both of the deflection rolls 98 and 100 there is effective upon the foil 94' a weighting or tensioning lever 106. This weighting lever 106 is pivotably mounted at a shaft journal 108 and at its free end 108*a* this weighting lever 108 rotatably carries a roll or roller 110. This roll or roller 110 bears upon the upwardly inclined extending section or portion of the material of the foil or web 94' and tensions such by virtue of the applied weight of the weighting lever 106.

Continuing, it will be observed that the roll 92 is mounted at a shaft or shaft member 114 and is coupled with one side of a magnetic clutch or coupling 115 or equivalent structure. The roll 92 is operatively connected with the chain 90. A further chain or chain member 116, which is operatively connected with the band or belt conveyor 102, can be placed in operative association or connection with the roll 92 by means of the magnetic clutch 115 or equivalent structure. There is also arranged or supported at the frame 10 a brake unit or device 118, the brake head 120 of which can be brought to brakingly act upon the roll 92. A further roll or roll member 122 acts upon the outer side or face of the foil 94' which is guided about the roll 92. This further roll 122 is mounted at a pivotable frame or frame member 124 which is pre-biased toward the foil or foil material 94'. This further roll or roller 122 is provided with an internally arranged conventional free-wheeling device, generally indicated by reference character 122', so that it only can rotate in the feed or advance direction K of the foil 94' and any oppositely directed or retro-rotation of this further roll 122 is suppressed by the free-wheeling action of the free-wheeling device 122' within such roll 122.

The band conveyor 102 comprises an endless band or belt 130 which is guided about two stationarily arranged rolls or rollers 126 and 128. The material of the foil or web 94' comes to bear at the conveying-active run of the endless band or belt 130 of the band conveyor 102. Of course, it would be possible to provide a plurality of mutually parallel and revolving bands or belts instead of the single band or belt 130. By means of a further chain or chain member 132, the roll 126 is operatively connected with a conveying or feed roll 134 which is likewise spatially stationarily but rotatably mounted at the frame 10. The conveying or feed roll 134 bears at the friction drive 66 so that this friction drive 66 is placed into co-rotation a drive chain 136 or the like from the drive unit or drive 64.

Figure 3:
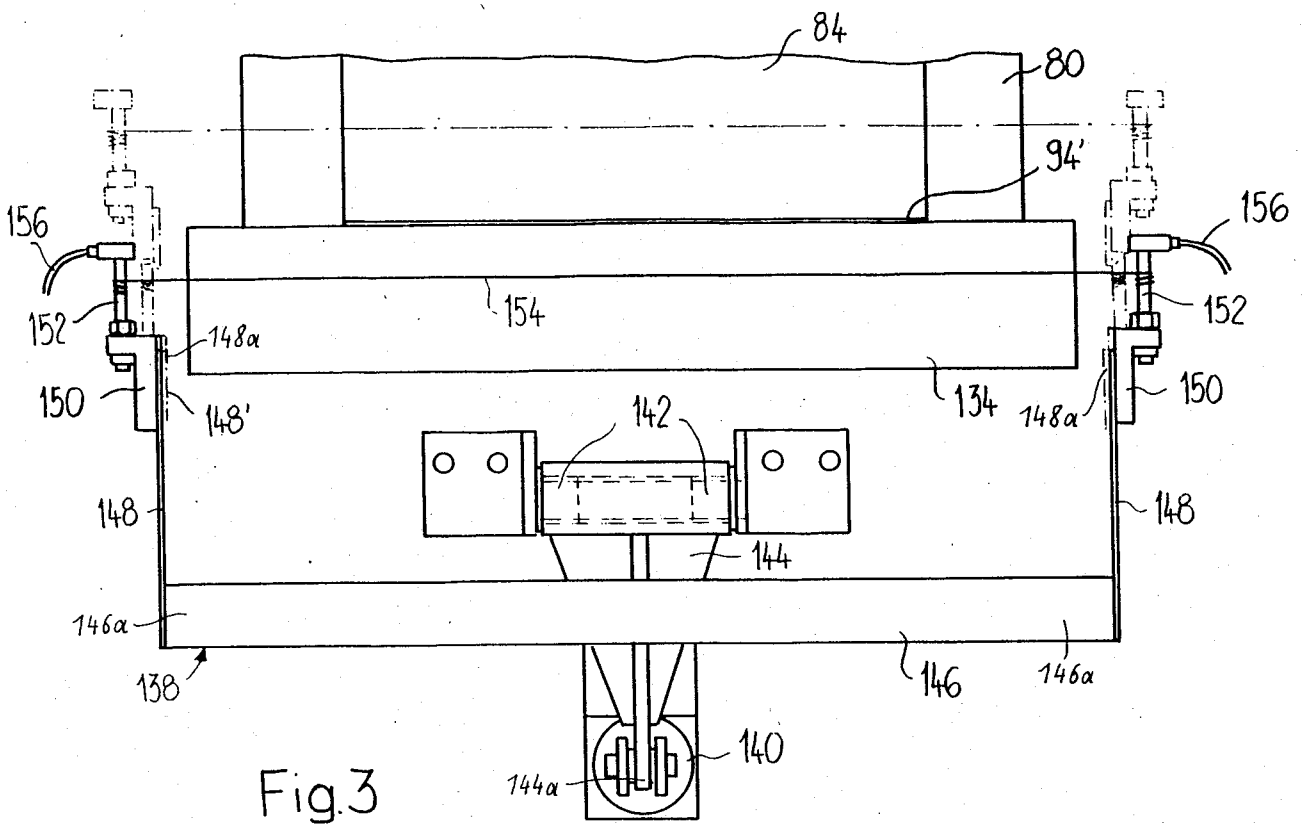
FIG. 3 illustrates in front view, again looking in the direction of the arrow A of FIG. 1, and on an enlarged scale a cutter or severing device for cutting or severing the foil forming the holding element or wrapper for the wound printed product package, wherein again certain of the components or parts have been conveniently omitted for clarity in the portrayal and convenience in illustration.

There is likewise pivotably mounted at the frame 10 a cutter or severing device 138. This cutter or severing device 138 can be pivoted or displaced by means of a further piston-and-cylinder unit 140 from a rest position depicted in full lines in FIG. 1 into a chain-dot portrayed cutting or severing position, likewise shown in FIG. 1. There will now be described with the aid of FIGS. 1 and 3 the cutter or severing device 138 in greater detail. A lever arm or arm member 144 is pivotably mounted at a stationary pivot bolt 142. At the free end 144*a* of this lever arm 144 there is operatively coupled the piston-and-cylinder unit 140. A cantilever or beam member 146 which is secured to the central or intermediate region of the lever arm 144 extends substantially parallel to the axis of the pivot bolt or bolt member 142. At the opposed or oppositely situated ends 146*a* of the cantilever or beam member 146 there is arranged a respective blade or leaf spring 148 or other resilient element. At the free ends 148*a* of these blade or leaf springs 148 there are provided insulating bodies or body members 150 at which there are secured holding or retaining pins or pin members 152. A heating wire or heating element 154 or equivalent heating structure is spanned between the holding pins 152. The opposite ends of the heating wire or element 154 are wound about each of the associated holding pins 152, as shown in FIG. 3. Connection wires or leads for the infeed of current or power for heating the heating wire or element 154 have been conveniently designated by reference character 156.

Also, in the illustration of FIGS. 3, there has been depicted in full lines the rest or ineffectual position of the cutting or severing device 138, and the heating wire or element 154 has elongated or expanded owing to the thermal action. Upon cooling of the heating wire or element 154 it contracts, so that the ends 148*a* of the blade or leaf springs or spring members 148 approach one another, and this condition has been depicted in chain-dot lines in FIG. 3 and designated by reference character 148'. In the rest or ineffectual position or state of the cutting or severing device 138, the heating wire or element 154 is located at the region of the feed or conveying roll 134 and when rocked into the cutting position, shown in chain-dot lines, is guided through the foil or web 94' between the band conveyor 102 and the feed or conveying roll 134.

As a result, the foil or web section which has been delivered to the wind-up location or station 18 is severed from the remainder of the material of the foil or web 94'. This cut-off or severed foil or web section serves as the holding or holder element or wrapper 84 to prevent unravelling or disintegration of the formed product package 80. As soon as the foil or web 94' has been cut or severed, then the cutting or severing device 138 again returns back into its rest or ineffectual position.

Based upon the illustration of FIGS. 1 to 3, there will be now described the mode of operation of the previously discussed apparatus for the fabrication of portable, substantially tubular-shaped printed product packages 80 which have been wound-up into a product roll from printed products 16 infed in an imbricated or shingled formation S as well as the fabrication of the holding or holder element or wrapper 84 which extends about the formed product roll from which there is ultimately produced the secured printed product package in order to retain together such product roll and prevent unravelling of the ultimately produced printed product package 80. For this purpose, there will be initially considered the operation of the foil delivery or supply device 82 for the holding or holder element or wrapper 84. The feed or conveying roll 134 as well as the roll or roller 126 of the band conveyor 102 are driven so as to rotate in a clockwise direction or sense, so that the conveying-active run of the band or belt 130 is moved in the direction of the arrow K. If there should not be furnished a foil or web section serving as the holding element or wrapper 84 to the wind-up location or station 18, then the magnetic clutch 115 is released and the roll 92 is prevented from rotating owing to the extended brake head 120 of the brake unit 118. Since the foil 94' is clamped against the roll 92 by the further roll 122 which is pre-biased against this roll 92, the foil 94' cannot advance or be forwarded in the direction of the arrow K. The end section of the foil 94' which extends up to the region of the heating wire or element 154 thus slidingly bears upon the conveying-active run of the band conveyor or conveyor device 102.

Since also the chain or chain member 90 is decoupled from the chain or chain member 116 owing to the released magnetic clutch 115, the foil supply roll 94 cannot rotate and by virtue of the weighting lever 106 the foil 94' is stretched or tensioned between the foil supply roll 94 and the roll or roller 92.

As soon as a foil section should be delivered to the wind-up location or station 18, as such also will be described more fully hereinafter, the brake or braking head 120 is raised off of the roll or roller 92 by means of the brake or braking unit 118 and the magnetic clutch 115 is activated. The aforedescribed free-wheeling action of the roll or roller 122 precludes any retro movement of the foil 94' opposite to the direction of the arrow K. Consequently, the roll 92 begins to rotate in the clockwise direction, so that the free end of the foil 94' is delivered in the direction of the arrows K and H to the wind-up location or unwinding roll 88 is smaller than the circumferential velocity of the roll 92, the unwinding or pay-off velocity of the foil supply roll 94 is also smaller than the velocity with which the foil 94' is forwarded from the roll 92 to the band conveyor 102. This results in a slight elongation of the foil section or portion located between the foil supply roll 94 and the roll 92. This foil elongation can be retained with the aid of the band conveyor 102 and the feed or conveying roll 134 up to the location of the wind-up location or station 18. The foil 94' advantageously comprises an elastic plastic or synthetic material which responds to this foil elongation by producing a tensile or traction force which imparts a good retaining action to the printed products 16 which have been wound-up into a product roll. As soon as a sufficiently large section of the foil 94' has been infed to the wind-up location or station 18, then the magnetic clutch 115 is released and the free-wheeling action of the roll or roller 122 prevents movement of the foil 94' opposite to the direction of the arrow K. This roll 92 is braked by means of the braking unit 118 so that the foil supply roll 94 also is brought to a standstill. The band conveyor 102 continues to move so that the foil elongation of the portion or part of the foil 94' which bears upon such band conveyor 102 is retained. The foil 94' is severed by means of the heated heating wire or element 154 from the foil section or portion which has been delivered to the wind-up location or station 18. The cutting or severing device 138 then again rocks back into its rest or ineffectual position.

At the start of the winding-up operation, the pivotable lever or lever member 32 together with the winding core or mandrel 30 is disposed in the lower position depicted in full lines in FIG. 1, whereas the deflection roll 52 assumes the chain-dot illustrated position and the deflection roll 46 assumes the end or terminal position depicted in full lines. The belt or belt element 38 now travels from the deflection roll 40 over the deflection rolls 42 and 44 to the deflection roll 46, from that location again over the deflection roll 44 to the deflection roll 48. From this deflection roll 48 the belt or belt element 38 travels about the deflection roll 49 and moves along the lower situated run of the band conveyor 14 up to the location of the deflection roll 50 and thereafter extends substantially parallel to the upper run of the band conveyor 14 until arriving at the winding core or mandrel 30. This winding core or mandrel 30 is wrapped by the belt or belt element 38 along a portion of its circumference. The belt or belt element 38 then extends over the deflection roll 52 and travels back to the deflection roll 40. The belt 38 has been partially illustrated in chain-dot lines.

The imbricated formation S of printed products 16 which have been delivered by the band conveyor 12 arrive by means of the roll 128 of the band conveyor 102 and the feed or conveying roll 134 at the second band conveyor 14 and while bearing upon the belt or belt element 38 are delivered to the winding core or mandrel 30. This winding core or mandrel 30 is driven so as to rotate in counter-clockwise direction by the action of the belt or belt element 38. The infed imbricated formation S of printed products 16 are wound between the winding core or mandrel 30 and the belt 38 so as to bear or be placed upon the winding core or mandrel 30. As the wound printed product roll or package which is being formed increases in its size or radius, and which printed product roll bears upon the band conveyor 14, the winding core 30 is raised and upwardly pivoted or rocked in the direction of the arrow D, about the pivot or lengthwise axis which is defined by the shaft or shaft member 34, as such has been illustrated in FIG. 1 in chain-dot lines. In order to compensate the length of the endless belt or belt element 38 the lever 54 together with the deflection roll 46 pivots in counter-clockwise direction from the position designated by the respective reference numerals 54 and 56 in the direction of the arrow E towards the end or terminal position which has been designated by the respective reference characters 54' and 46'. As soon as the last printed products 16 which are to be wound-up, of the imbricated formation S have approached the wind-up location or station 18, then, in the manner as described previously, the free end of the material of the foil or web 94' together with such printed products 16 are delivered to the wind-up location or station 18.

Since the printed products 16 come to repose upon the foil or web 94' the portion or part of the foil section which trails the imbricated formation or stream S of the printed products 16, following the product wind-up operation, encloses the product roll formed of printed products 16 and which have been formed upon the winding core or mandrel 30. As soon as a sufficiently long foil section has been forwarded or advanced to the wind-up location or station 18, then the foil or web 94' is cut or severed.

After completion of the printed product package 80, the double-armed lever 58 is pivoted back by means of the piston-and-cylinder unit 62 into the position designated by reference character 58' and at the same time, the piston-and-cylinder unit 28 retracts the carriage or carriage member 20 from the chain-dot depicted position of FIG. 1 into the position shown in full lines in such FIG. 1. As a result, the printed product package 80 rolls off of the band conveyor 14 and is rocked from the chain-dot position downwardly in the direction of the arrow D into the lower end or terminal position shown in full lines and which is defined or fixed by the impact or stop member 36. The winding core 30 thus pivots back into the operative region of the ejector device 68 which, upon actuation of the piston-and-cylinder package 80 from the winding core or mandrel 30 and feeds such so that it reposes upon the support table 78. The ejector device 68 is then immediately again retracted back into the starting or ineffectual position. Upon renewed advancement, of the carriage or carriage member 20 into the chain-dot depicted position as shown in FIG. 1 as well as placement of the double-armed lever 58 into the likewise chain-dot depicted position, then the apparatus is ready for the fabrication of a further printed product package or roll 80.

It is to be observed that the loose or freely rotatable supporting of the foil supply roll 94 upon both of the unwinding rolls or rollers 86 and 88, simplifies to an appreciable degree the installation or donning of a new replacement foil supply roll 94. This new replacement foil supply roll 94 can simply be placed upon the unwinding rolls 86 and 88 and the free foil end can be threaded or placed about the rolls 96, 98, 110 and 100 and conducted to the rolls 92 and 122 and to the band conveyor 102. For this purpose, the magnetic clutch 115 as well as the brake or braking unit 118 are released, with the result that the unwinding roll 88 and thus also the foil supply roll 94, the roll 92 and the roll 122 are freely rotatable in the foil unwinding or pay-off direction.

It is also to be understood and appreciated that the foil supply roll 94 can be braked with other means or facilities than by the chain 90 and the unwinding roll 88, for instance by means of a brake or brake device which acts upon the circumferential or outer surface of the foil supply roll.

It is equally possible to cut or sever the foil section furnished by the foil supply roll 94 before such foil section has been delivered to the path of travel of the imbricated formation S of the printed products 16 and thus to the wind-up location or station 18.

It is finally mentioned that the holding or holder element or wrapper 84 is preferably a transparent plastic foil 94' having self-adhesive properties.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for the fabrication of portable, substantially tubular-shaped packages formed of printed products, such as newspapers, magazines, periodicals and the like, infed in imbricated formation and wound-up into a product roll, and for winding-up a holding element extending about the product roll for retaining together the product roll, comprising:

infeed means for the infeed of an imbricated formation of printed products along a predetermined path of travel;

a winding-up station arranged downstream of said infeed means with respect to said predetermined path of travel of the infed imbricated formation of printed products for winding-up the infed imbricated formation of printed products into a product roll;

a delivery device for the delivery of at least one holding element for wrapping about said product roll formed of the wound printed products;

said delivery device delivering the holding element into the predetermined path of travel of the imbricated formation of printed products at a side of the predetermined path of travel of the imbricated formation of printed products which faces away from the center of said product roll;

said delivery device comprising a foil supply roll for supplying a foil;

said at least one holding element comprising a section of said foil which has been unwound from said foil supply roll;

said delivery device including means for the infeed of said foil into the predetermined path of travel of the imbricated formation of printed products;

said means for the infeed of said foil into the predetermined path of travel of the imbricated formation of printed products comprises a revolvingly driven surface;

said revolving driven surface being in contact with the foil which is unwound from the foil supply roll;

said delivery device including means for feeding said foil step by step;

said delivery device further including means for severing said section of the unwound foil;

said means for severing said section of the unwound foil being arranged downstream of said revolvingly driven surface; and said means for severing said section of the unwound foil being activatable after each feeding step of said foil.

2. The apparatus for the fabrication of portable substantially tubular-shaped packages as defined in claim 1, wherein:

said means for the infeed of the foil into the predetermined path of travel of the imbricated formation of printed products comprises a revolvingly driven band conveyor;

said revolvingly driven band conveyor having a conveying-active run forming said revolvingly driven surface; and said conveying-active run of said revolvingly driven band conveyor of said delivery device coming into contact with the foil which is unwound from the foil supply roll.

3. The apparatus for the fabrication of portable substantially tubular-shaped packages as defined in claim 1, wherein:

said delivery device includes means for unwinding the foil from said foil supply roll;

said means for the unwinding the foil from the foil supply roll comprises two substantially parallel, mutually spaced rotatably mounted unwinding rolls for loose rotatable supporting of said foil supply roll; and at least one of said two parallel, mutually spaced rotatably mounted unwinding rolls comprises at least one driven roll.

4. The apparatus for the fabrication of portable substantially tubular-shaped packages as defined in claim 3, further including:

means for brakingly driving said at last one driven roll of said two unwinding rolls.

5. The apparatus for the fabrication of portable substantially tubular-shaped packages as defined in claim 3, wherein:

said means for the infeed of the foil into the predetermined path of travel of the imbricated formation of printed products comprises a revolvingly driven band conveyor;

said revolvingly driven band conveyor having a conveying-active run forming said revolvingly driven surface;

said conveying-active run of said revolvingly driven band conveyor of said delivery device coming into contact with the foil which is unwound from the foil supply roll;

at least one of said two parallel, mutually spaced rotatably mounted unwinding rolls comprises at least one driven roll;

said at least one driven roll comprises a brakingly driven roll; and means for drivingly coupling said at least one driven roll with said revolvingly driven band conveyor of said delivery device.

6. The apparatus for the fabrication of portable substantially tubular-shaped packages as defined in claim 3, wherein:

said means for the infeed of the foil into the predetermined path of travel of the imbricated formation of printed products comprises a revolvingly driven band conveyor;

said revolvingly driven band conveyor having a conveying-active run forming said revolvingly driven surface;

said conveying-active run of said revolvingly driven band conveyor of said delivery device coming into contact with the foil which is unwound from the foil supply roll;

means for drivingly coupling said at least one driven roll with said band conveyor of said delivery device;

braking means which can be brought to act upon the foil supplied by said delivery device; and said braking means being arranged upstream of said band conveyor of said delivery device.

7. The apparatus for the fabrication of portable substantially tubular-shaped packages as defined in claim 6, wherein:

said braking means comprises a pair of rolls acting at opposite faces of the foil;

said pair of rolls defining a first roll and a second roll;

means for drivingly coupling said first roll with said band conveyor of said delivery device; and said second roll being structured to have a free-wheeling action in a predetermined direction of feed of said foil.

8. The apparatus for the fabrication of portable substantially tubular-shaped packages as defined in claim 7, wherein:

said braking means comprises a brake unit for exerting a braking action upon said first roll.

9. The apparatus for the fabrication of portable substantially tubular-shaped packages as defined in claim 6, further including:

tensioning means for tensioning the foil and arranged between said braking means and said unwinding rolls.

10. The apparatus for the fabrication of portable substantially tubular-shaped packages as defined in claim 1, further including:

frame means;

said severing means comprising a heating element tensionally suspended at said frame means; and means for pivoting said heating element into a predetermined path of travel of the foil.

11. The apparatus for the fabrication of portable substantially tubular-shaped packages as defined in claim 10, wherein:

said heating element comprises a heating wire tensionally suspended at said frame means.

12. The apparatus for the fabrication of portable substantially tubular shaped packages as defined in claim 1, wherein:

said winding-up station comprises a rotatably mounted winding core;

means for placement of the printed products upon one of the winding core and printed products already wound upon said winding core;

said placement means drivingly acts upon a side of the printed products which faces away from the winding core;

said placement means for placement of the printed products upon the winding core comprises an endless belt element guided about said winding core and about said at least one holding element at least during the winding-up of the printed products; and the infed printed products are introduced between the winding core and the belt element.

13. The apparatus for the fabrication of portable substantially tubular-shaped packages as defined in claim 12, further including:

means for revolvingly driving said endless belt element.

14. The apparatus for the fabrication of portable substantially tubular-shaped packages as defined in claim 12, wherein:

said infeed means comprises a band conveyor;

the apparatus further comprises means for displaceably mounting said band conveyor;

said band conveyor being arranged beneath said winding core and said displaceable out of an operating region of said winding core;

said band conveyor having a conveying-active run; and one of said winding core and a product roll of printed products are loosely rotatably placeable upon said conveying-active run of said band conveyor.

15. The apparatus for the fabrication of portable substantially tubular-shaped packages as defined in claim 14, wherein:

said band conveyor guides at least a portion of said belt element at said band conveyor and which portion of said belt element is located upstream of said winding core with respect to said predetermined path of travel of the infed imbricated formation of printed products so as to extend substantially parallel to said conveying-active run of said band conveyor.

16. The apparatus for the fabrication of portable substantially tubular-shaped packages as defined in claim 12, further including:

tensioning means forming a supply loop for said belt element.

17. The apparatus for the fabrication of portable substantially tubular-shaped packages as defined in claim 14, wherein:

said winding core has a lengthwise axis;

a shaft member having a lengthwise axis extending substantially parallel to the lengthwise axis of said winding core;

a pivotable lever pivotably mounted at said shaft member for pivotal movement about said lengthwise axis of said shaft member;

said pivotable lever being movable into a lower end position;

said winding core being rotatable arranged at said pivotable lever; and stop means for determining said lower end position of said pivotable lever such that the lengthwise axis of said winding core extends above said conveying-active run of said band conveyor.

18. The apparatus for the fabrication of portable substantially tubular-shaped packages as defined in claim 17, comprising:

ejector means for ejecting a finished portable substantially tubular-shaped package of the wound printed products wound into the product roll and around which there has been wound the holding element;

said ejector means being mounted at a spatially predetermined location;

said ejector means including a displaceable stripper element;

said ejector means partially engaging about said winding core in said lower end position of said winding core; and means for displacing said stripper element in the direction of said lengthwise axis of said winding core.

19. The apparatus for the fabrication of portable substantially tubular-shaped packages as defined in claim 1, comprising:

ejector means for ejecting a finished portable substantially tubular-shaped package of the wound printed products into the product roll and around which there has been wound the holding element.

20. An apparatus for the fabrication of portable, substantially tubular-shaped packages formed of printed products, such as newspapers, magazines, periodicals and the like, infed in imbricated formation and wound-up into a product roll, and for winding-up a holding element extending about the product roll for retaining together the product roll, comprising:

infeed means for the infeed of an imbricated formation of printed products along a predetermined path of travel;

a rotatably mounted winding core arranged downstream of said infeed means with respect to said predetermined path of travel of the infed imbricated formation of printed products;

means for placement of the printed products upon one of the winding core and printed products already wound upon said winding core;

said placement means drivingly acting upon a side of the printed products which faces away from the winding core;

a delivery device for the delivery of at least one holding element for wrapping about a product roll formed of the wound printed products;

said delivery device delivering the holding element into the predetermined path of travel of the imbricated formation of printed products at a side of the predetermined path of travel of the imbricated formation of printed products at which there is effective the placement means for the placement of the printed products upon the winding core;

ejector means for ejecting a finished portable substantially tubular-shaped package of the wound printed products wound into the product roll and around which there has been wound the holding element;

said delivery device for the at least one holding element comprising a foil supply roll for supplying foil;

said at least one holding element comprising a section of foil which has been unwound from said foil supply roll;

means for the infeed of a severed section of the foil into the predetermined path of travel of the imbricated formation of printed products comprising a revolvingly driven band conveyor;

said revolvingly driven band conveyor having a conveying-active run;

said conveying-active run of said revolvingly driven band conveyor of said delivery device coming into contact with the foil which is unwound from the foil supply roll;

said delivering device including means for feeding said foil step by step;

said delivery device further including means for severing a section of the unwound foil;

said means for severing the section of the foil being arranged downstream of said revolvingly driven band conveyor; and said means for severing the section of the foil being activatable after each feeding step of said foil.

* * * * *